United States Patent [19]

Moore

[11] 4,346,520

[45] Aug. 31, 1982

[54] ALINEMENT METHOD

[76] Inventor: Tom E. Moore, 6105 Brandon Ave., Springfield, Va. 22150

[21] Appl. No.: 871,861

[22] Filed: Jan. 24, 1978

[51] Int. Cl.[3] ..... F41F 23/06

[52] U.S. Cl. ..... 33/180 R; 89/37 R; 248/176

[58] Field of Search ..... 89/36 K, 37 R, 37 A; 248/176, 178, 179, 180, 295 R, 411, 514, 515; 33/180 R

[56] References Cited

U.S. PATENT DOCUMENTS

| | | | |
|---|---|---|---|
| 697,843 | 4/1902 | Howland et al. . | |
| 711,967 | 10/1902 | Hichborn et al. . | |
| 1,340,111 | 5/1920 | Bonali | 89/37 A |
| 2,245,901 | 6/1941 | Chaskin | 248/178 |
| 3,261,262 | 7/1966 | Hilfing et al. | 89/36 K |
| 4,031,838 | 6/1977 | Schmidt et al. | 114/1 |

FOREIGN PATENT DOCUMENTS

| | | | |
|---|---|---|---|
| 378 | of 1914 | United Kingdom | 89/37 R |

OTHER PUBLICATIONS

*Alinement of Ordnance Installations Aboard Ship,* NAVORD OP 762, Second Revision, Jun. 1, 1960, Chapters 1–3.

Naval Ordnance and Gunnery, vol. 1, "Naval Ordnance" NAVPERS 10797, 1955, pp. 142–143.

*Primary Examiner*—Stephen C. Bentley

[57] ABSTRACT

A method and apparatus for aiding the alinement of an element, carried on supporting surface, requiring parallelism to a reference plane or axial orthogonality to that reference plane. A first and second ring are disposed between the element and surface and the second ring, having an interfacing plane, is manipulated such that the interfacing plane is parallel to the reference plane. Suitable attachment is made to assure fixture of the second ring relative to the first ring which is fixed with respect to the surface.

1 Claim, 2 Drawing Figures

ALINEMENT METHOD

BACKGROUND OF THE INVENTION

The present invention relates generally to alinement methods and apparatus, and more particularly to a method and apparatus to aid in the provision of a plane surface which is parallel to a reference plane for installation of rotating ordnance equipment on the deck of a ship.

Alinement procedures may be divided into two separate types: the procedures for alining the ordnance element within itself and the procedures for system alinement, i.e., alining a group of elements or equipment comprising an ordnance installation with each other. It is noted that the principles and procedures explained in this application are applicable to any group of weapons and control equipment. Thus, the general terms "element" or "equipment" are used extensively to designate the individual components of an installation and may mean a gun director, gun mount, turret, rocket launcher, shock platform, radar, gyro compass, or other unit of ordnance equipment.

The alinement of an ordnance element within itself consists principally of steps taken to insure that the element is constructed accurately and adjusted so that its movements are smooth and precise and that, by itself, the element functions as intended. This type of alinement is largely a matter of manufacture and installation and seldom requires adjustment except to correct for tampering, damage and wear.

System alinement consists of the procedures for orienting and adjusting to each other the several elements that constitute a fire control system or battery so that the system as a whole functions properly. These procedures in a first case, refer to the adjustment of the elements so that all associated weapon bores, sight telescopes, radar antennas and other similar lines are parallel (when no parallax or ballistic corrections have been made) and remain parallel throughout their operating motions. These procedures also refer to the adjustment of their related dials of the elements so that they read correctly with respect to established references and the adjustment of synchros which transmit and receive the correct angles. System alinement, as explained in the former case, is the subject with which this application is broadly and mainly concerned.

An important concept in the principles of alinement procedures with respect to ordnance elements is that of the reference plane. The plane in which train angles are measured and normal to which elevation angles are measured, in a two-axis element, is various referred to as "battery reference plane", "deck plane" or simply "reference plane". All of these terms means the same thing, i.e., an arbitrarily selected plane, approximately parallel to the deck, with which train roller paths of all the elements are made parallel to insure that all the elements are parallel to each other. The selected plane may be the actual roller path plane of one of the elements, which one would be governed solely by convenience. It may be a leveling plate set well down in the hull where hull distortion is a minimum, or an imaginary plane without tangible embodiment whatsoever, an example of which is the frequently used "mean plane" or "resultant plane".

Accuracy of fire, which is dependent to a marked degree upon the accuracy of alinement between elements, is thus not dependent at all upon whether or not the reference plane and element roller paths are meticulously alined with any ship structure. It is important only that the planes of the elements be parallel to each other. Of course, extreme misalinement of ordnance elements with the structure of the ship would adversely affect ship stability, but such misalinement would have to be greatly in excess of any reasonably acceptable misalinement between elements before the effect would be perceptible.

Before the elements of an installation are initially installed aboard ship, the element foundations are carefully machined so that the roller path planes are parallel to each other within prescribed limits. Under practical conditions it is impossible to make the planes perfectly parallel. The accuracy with which the element foundations must be machined to parallelism depends upon whether shims, leveling rings, or other alinement refining devices, such as shown in U.S. Pat. No. 4,031,838, issued to Schmidt et al, may be used when the elements are installed. In general, however, alinement refining after installation is possible for the lighter elements only. In the case of heavy elements such as large gun directors, gun mounts and turrets, the desired degrees of parallelism must be attained in the foundation machining operations. This aspect of the prior art tends to make installation costs exceedingly high.

A requirement thus exists for an alinement procedure which eases installation labors, is economical and insures the accuracy of an installation requiring parallelism to a reference plane.

SUMMARY OF THE INVENTION

Accordingly, it is an object of the present invention to provide a new and improved alinement method and apparatus.

Another object of the present invention is to provide a new and improved alinement method and apparatus which insures the accuracy of installations requiring parallelism of a surface to a reference plane.

Still another object of the present invention is to provide an alinement method and apparatus which greatly facilitates installation requiring parallelism of a surface to a reference plane.

A further object of the invention is to provide an improved alinement method and apparatus which can be used with great economy.

A still further object of the invention is to provide an improved mounting device to aid in the alinement of a normally surface mounted element requiring parallelism to a reference plane.

These and other object of the invention are attained in an alinement method and apparatus, for surface mounted elements requiring parallelism to a reference plane, having an improved mounting device comprising a first ring interfitted within a second ring. After the first ring is fixed to the surface, an interfacing plane, which is formed on the second ring is manipulated to a position which is parallel to the reference plane. After this initial orientation of the interfacing plane, the first ring is fixed, e.g., welding or bolting, to the second ring.

BRIEF DESCRIPTION OF THE DRAWINGS

A more complete understanding of the invention and a fuller appreciation of the many attendant advantages, features and still other objects thereof will be readily observed by reference to the following detailed description when considered in connection with the accompanying drawings, wherein.

DESCRIPTION OF THE PREFERRED EMBODIMENT

Figure 1:
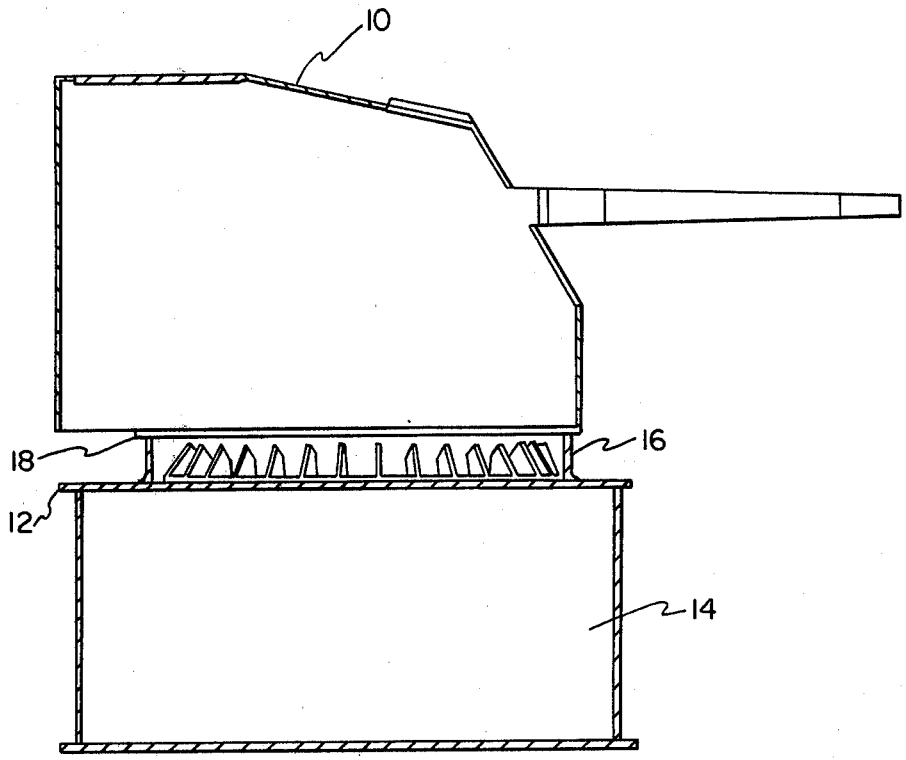
PRIOR ART FIG. 1
FIG. 1 is a cross sectional view of one embodiment of the prior art.

Referring now to the drawings, wherein like reference characters designate identical or corresponding parts throughout the several views, and more particularly to FIG. 1 thereof wherein one embodiment of the prior art is shown in cross section, and includes a gun 10 being mounted on a deck 12 of a ship. Disposed beneath the deck 12 is a handling room 14 which encloses various controllers for the gun and additional support structure. Located between deck 12 and gun 10 is a barbette, designated 16. Barbette 16 is a built-up structure of beams and weldments which is used to stiffen the ship's deck. Inasmuch as gun 10 belongs to the class of rotating elements which have a plane requiring parallelism to a reference plane or whose axis must be normal to that reference plane, an interfacing plane 18 is provided on barbette 16. Interfacing plane 18 can be machined by, e.g. milling, so that it has acceptable parallelism to the reference plane, which arbitrarily could be deck 12. After machining, gun 10 is mounted on the barbette thereby completing one phase of a system alinement procedure.

However, as was noted, the machining costs and labor requirements in this prior art method can be prohibitive. Furthermore, the accuracy of the method, under certain circumstances, may be insufficient to meet specified criterion.

Figure 2:
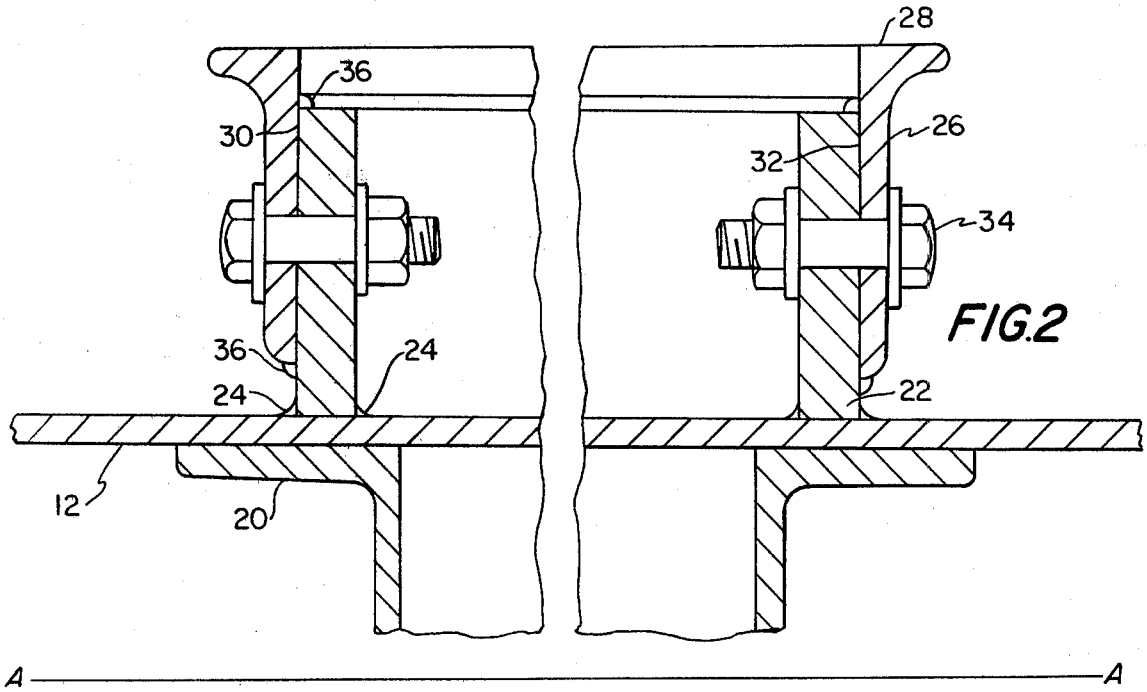
FIG. 2 illustrates a cross sectional view of a preferred form of the present invention.

Referring now to FIG. 2, an embodiment of the present invention is shown in cross section, and includes a surface such as deck 12 being mounted on support structure 20. Disposed on the deck 12 is a first annular member such as ring 22 which can be fixed to the deck 12 by welds 24. A second annular member such as ring 26 is loosely fitted over first ring 22 and includes an interfacing plane 28 which can be made parallel to a reference plane such as fixed plane A—A.

Plane 28 is designed to be the direct support for deck-mounted elements or equipment, not shown, which require parallelism to a reference plane as explained supra. Ring 26 is formed of a suitable material, e.g., steel, in a right angle or channel configuration.

The vertical surface 30 of ring 26 is a faying surface for the ring 22 which has previously been coped to and welded to the deck without the necessity of establishing high accuracy of its plane or near plane top surface. Ring 22 merely carries the necessity for a reasonably accurate "metal-to-metal" fit of its formed surface 32 which mates with the corresponding surface 30 of the ring 26. A small clearance exists between faying surface 30 and formed surface 32 in order that interfacing plane 28 may be manipulated or physically moved by some mechanical means, e.g. jacks, into a parallel position with reference plane A—A.

When ring 26 is positioned roughly to its final position in contact with ring 22, it is jacked and clamped into the precise plane-parallel position (parallel to the reference plane). Conventional techniques may be used in ascertaining zero elevation of interfacing surface 28 of ring 26 so that the plane of the surface is parallel to the reference plane. These techniques may include: the shore transit method, the deck transit method or the gunner quadrant method.

Suitable attachment, for example by welds or other mechanical fastening such as bolts 34, is then made to insure permanence of the position of ring 26 with respect to ring 22 and thus with respect to the reference plane. Suitable sealant material, such as shown at 36 is then applied to all interfacing surfaces between rings 26 and 22 in order to protect the surfaces from corrosion. The levelled top surface 28 of ring 26 this becomes the surface against and upon which ordnance equipment or other equipment requiring parallelism is installed.

As can be seen, what has been disclosed is an alinement method and apparatus aid which eases installation labors, reduces the expense, and increases the accuracy of the installation of equipment which requires parallelism to a reference plane. The surface made parallel to the reference plane becomes the surface against which the equipment is installed. The use of this apparatus can also serve to reduce the weight of mounted equipment which will affect favorably the balance and stability of a ship.

While ordnance elements and ordnance-related equipment have been discussed it is clear that the above principles are applicable to any rotating body requiring parallelism to a reference plane or whose axis requires orthogonality to that plane.

Obviously numerious modification and varations of the present invention are possible in the light of the above teachings. It is therefore to be understood that within the scope of the appended claims the invention may be practiced otherwise than as specifically described herein.

What is claimed as new and desired as secured by Letters Patent of the United States is:

1. A method for aiding the mounting of any of a plurality of rotating elements on a surface, each of said elements requiring parallelism to a reference plane, comprising:

fixing a first ring on said surface, fitting a second ring about said first ring, said second ring having an interfacing plane;

manipulating said second ring relative to said first ring such that said interfacing plane is parallel to said reference plane, maintaining said interfacing plane parallel to said reference plane, fixing said second ring to said first ring, mounting said element on said interfacing, plane, whereby each one of said plurality of elements is aligned with said reference plane as well as with each other.

* * * * *